US006465994B1

(12) United States Patent
Xi

(10) Patent No.: US 6,465,994 B1
(45) Date of Patent: Oct. 15, 2002

(54) LOW DROPOUT VOLTAGE REGULATOR WITH VARIABLE BANDWIDTH BASED ON LOAD CURRENT

(75) Inventor: Xiaoyu Xi, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/107,922

(22) Filed: Mar. 27, 2002

(51) Int. Cl.[7] ..... G05F 1/40; G05F 1/44
(52) U.S. Cl. ..... 323/274; 323/280
(58) Field of Search ..... 323/274, 273, 323/280, 281

(56) References Cited

U.S. PATENT DOCUMENTS 5,648,718 A * 7/1997 Edwards ..... 323/274
5,686,820 A * 11/1997 Riggio, Jr. ..... 323/273
5,686,821 A * 11/1997 Brokaw ..... 323/273
5,864,227 A * 1/1999 Borden et al. ..... 323/280
5,889,393 A * 3/1999 Wrathall ..... 323/280
6,046,577 A * 4/2000 Rincon-Mora et al. ..... 323/279
6,201,375 B1 * 3/2001 Larson et al. ..... 323/277
6,333,623 B1 * 12/2001 Heisley et al. ..... 323/224
6,373,233 B2 * 4/2002 Bakker et al. ..... 323/282

* cited by examiner

*Primary Examiner*—Bao Q. Vu
(74) *Attorney, Agent, or Firm*—Alan K. Stewart; Wade James Brady, III; Frederick J. Telecky, Jr.

(57) ABSTRACT

A low dropout voltage regulator includes: a first amplifier A1 having a reference voltage node VREF coupled to a first input; a second amplifier A2 having an input coupled to an output of the first amplifier A1; a variable bias current source I1 coupled to the first amplifier A1 and having a control node coupled to an output of the second amplifier A2; a power switch M1 having a control node coupled to the output of the second amplifier A2 and having a first end coupled to a source voltage node VDD; and a feedback circuit R1 and R2 having an input coupled to a second end of the power switch M1 and an output coupled to a second input of the first amplifier A1. The best node in the system that detects the load current level is the output of the second amplifier A2. This signal is used to modulate the bias current I1 of the first amplifier A1 by increasing the bias current when the load current increases and vice versa, which consequently modulates the transconductance of amplifier A1. This provides a higher bandwidth LDO with better transient performance and higher power supply rejection ratio.

20 Claims, 2 Drawing Sheets

LOW DROPOUT VOLTAGE REGULATOR WITH VARIABLE BANDWIDTH BASED ON LOAD CURRENT

FIELD OF THE INVENTION

This invention generally relates to electronic systems and in particular it relates to low dropout voltage regulators with variable bandwidth based on load current.

BACKGROUND OF THE INVENTION

A prior art general architecture of an internal compensated low dropout voltage regulator (LDO) is shown in FIG. 1. This LDO includes an error amplifier A1, a wide band gain stage A2 for better pole-splitting, a buffer BUF for impedance translation, an internal compensation cap Cc, a feedback resistor string R1 and R2, and an output power PMOS transistor PSW (power switch). The LDO also includes reference voltage VREF; bias voltage VBIAS; source voltage VDD; feedback voltage VFB; output current Iout; output voltage VOUT; equivalent series resistor (ESR) R_ESR; output filter capacitor C_FILT; and external load LOAD. If designed properly, the bandwidth, pole position of this LDO can be calculated by simply applying two stage amplifier equations a shown in the equations below.

$$\text{Dominant pole: } f_{Pd} = \frac{1}{2\pi \cdot (1 + A2 \cdot G_{mPSW} \cdot r_{oPSW}) \cdot r_{oA1} \cdot C_c} \tag{1}$$

$$\text{Second pole: } f_{P2} = \frac{A2 \cdot G_{mPSW}}{2\pi \cdot C_{FILT}} \tag{2}$$

$$\text{Open loop unity gain bandwidth: } f_{UGBol} = \frac{g_{mA1}}{2\pi \cdot C_C} \cdot \frac{R_2}{R_1 + R_2} \tag{3}$$

where $G_{mPSW}$ is the transconductance of transistor PSW; A2 is the gain of amplifier A2; Cc is the capacitance of capacitor Cc; $r_{oA1}$ is the output impedance of amplifier A1; $r_{oPSW}$ is the output impedance of transistor PSW; $C_{FILT}$ is the capacitance of capacitor C_FILT; and $g_{mA1}$ is the transconductance amplifier A1.

To satisfy stability criteria, the second pole $f_{P2}$ needs to be pushed close to or beyond the unity gain bandwidth $f_{UGBol}$. As we can see from equation (2), the second pole $f_{P2}$ moves with the transconductance of the power PMOS PSW, $g_{mPSW}$, which is proportional to $\sqrt{I_{OUT}}$. For an LDO, the output current ranges from a few uA's to hundreds of mA's, thus the transconductance $g_{mPSW}$ changes 2–3 decades and so does the second pole $f_{P2}$. For a conventionally designed LDO, the bandwidth $f_{uGBol}$ is limited by the worst-case second pole $f_{P2}$ where output current $I_{OUT}$ is minimum.

SUMMARY OF THE INVENTION

A low dropout voltage regulator includes: a first amplifier having a reference voltage node coupled to a first input; a second amplifier having an input coupled to an output of the first amplifier; a variable bias current source coupled to the first amplifier and having a control node coupled to an output of the second amplifier; a power switch having a control node coupled to the output of the second amplifier and having a first end coupled to a source voltage node; and a feedback circuit having an input coupled to a second end of the power switch and an output coupled to a second input of the first amplifier. The best node in the system that detects the load current level is the output of the second amplifier. This signal is used to modulate the bias current of the first amplifier by increasing the bias current when the load current increases and vice versa, which consequently modulates the transconductance of the first amplifier. This provides a higher bandwidth LDO with better transient performance and higher power supply rejection ratio.

DETAILED DESCRIPTION OF PREFERRED EMBODIMENTS

A higher bandwidth LDO is always desired for better transient performance, higher power supply rejection ratio (PSRR). For instance, with the same dc gain, doubling the bandwidth will give extra 6 dB on PSRR for frequency response. When designing a high PSRR LDO, for example 60 dB at 20 kHz with 300 mV headroom, this extra few dB of help can relax the requirement on dc gain hence ease the compensation.

Figure 1:
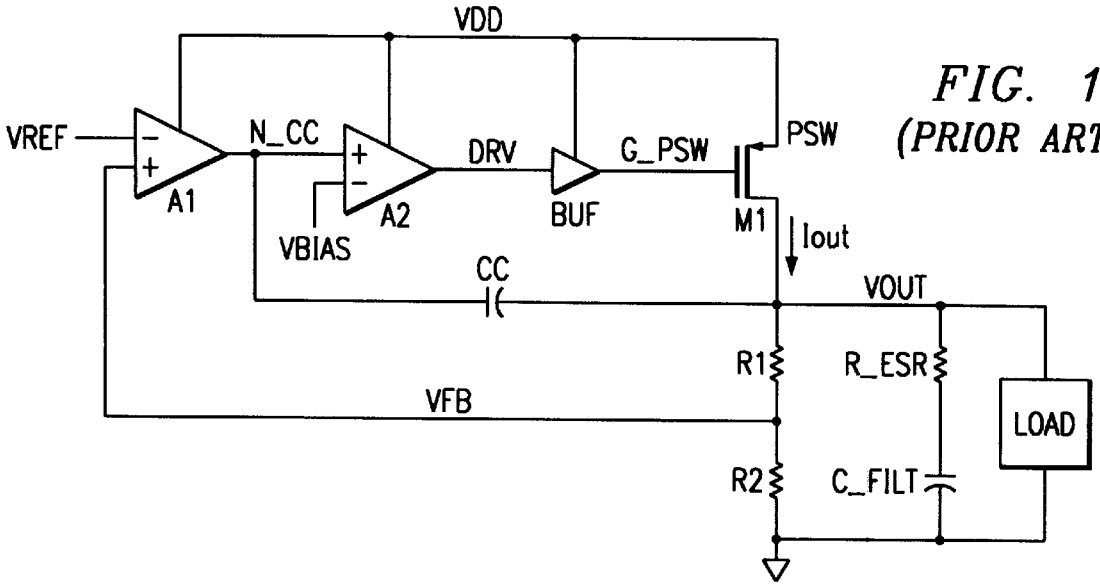
FIG. 1 (PRIOR ART)
FIG. 1 is a schematic circuit diagram of a prior art internal compensated low dropout voltage regulator.
Figure 2:
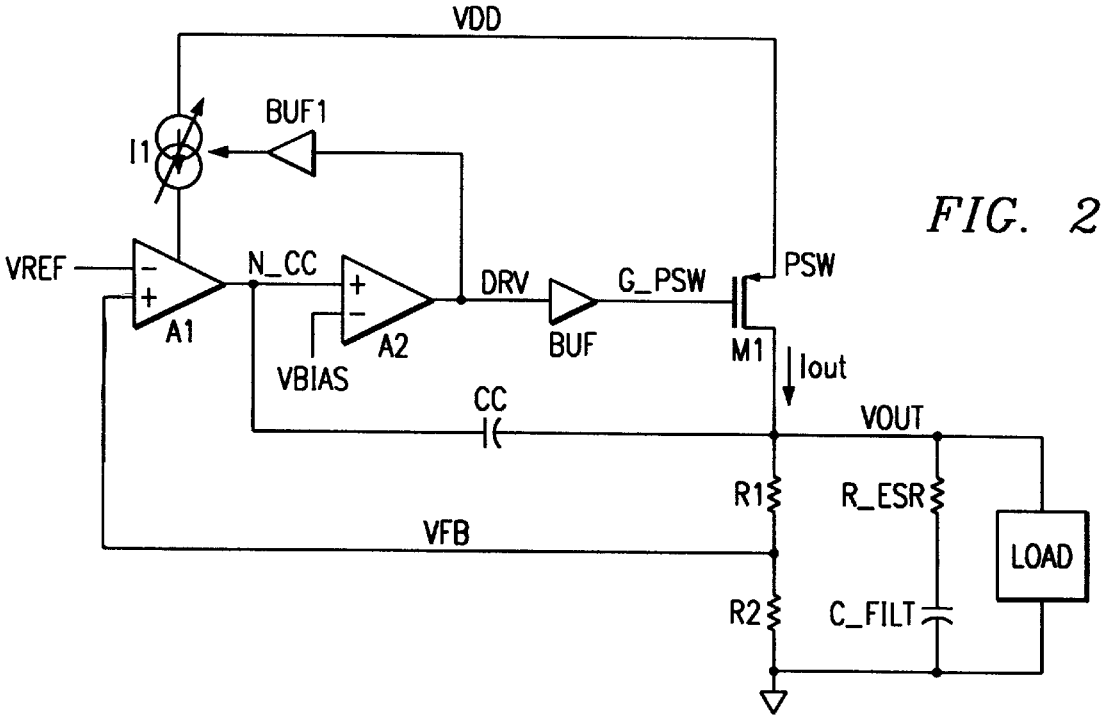
FIG. 2 is a schematic circuit diagram of a preferred embodiment low dropout voltage regulator with variable bandwidth based on load current level.

A preferred embodiment LDO with variable bandwidth based on the load current level is shown in FIG. 2. The circuit of FIG. 2 includes a feedback buffer BUF1 that adjusts the bias current I1 for amplifier A1. The remainder of the circuit in FIG. 2 is the same as the circuit of FIG. 1. Since the second pole $f_{P2}$ moves out as load current Iout increases, the bandwidth $f_{uGBol}$ can be adjusted accordingly so the stability margin is not degraded. The best node in the system that detects the load current level is node DRV, which is the same level as the gate of the power PMOS PSW. As the load current Iout increases, node DRV moves lower and vice versa. This signal can be used to modulate the bias current I1 of error amplifier A1 and hence modulate its transconductance $g_{mA1}$. For example, node DRV can drive a PMOS switch that passes a higher bias current into amplifier A1. A schematic implementation for this example is shown in FIG. 3.

Figure 3:
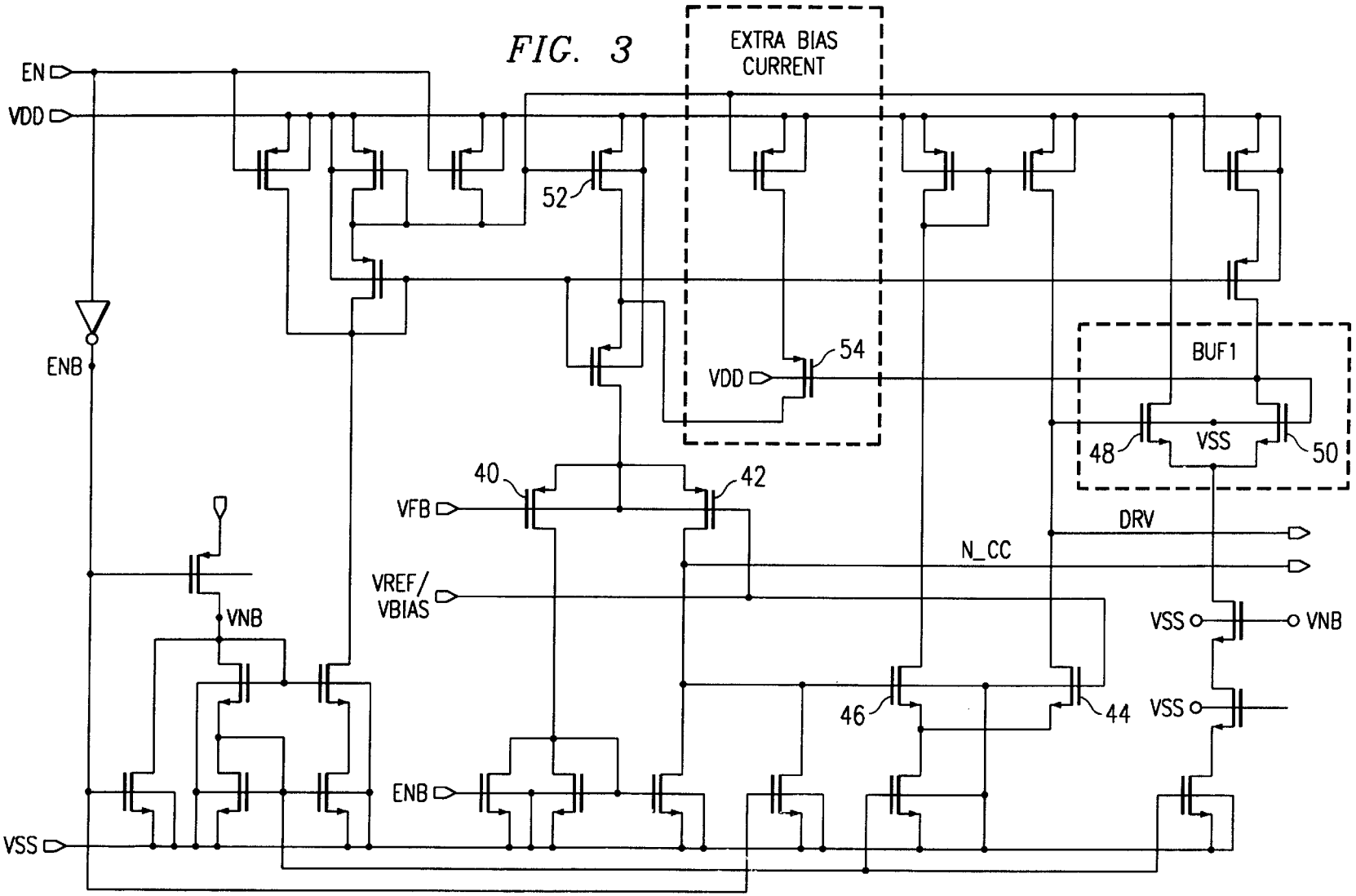
FIG. 3 is a detailed schematic circuit diagram of an example implementation of a portion of the circuit of FIG. 2.

The circuit of FIG. 3 only includes amplifiers A1 and A2, buffer BUF1, and current source I1 from the preferred embodiment architecture of FIG. 2. Amplifier A1 includes differential PMOS transistors 40 and 42. Amplifier A2 includes differential NMOS transistors 44 and 46. Buffer BUF1 includes NMOS transistors 48 and 50. Variable current source I1 includes PMOS transistors 52 and 54 (MP_SW). In the circuit of FIG. 3, reference voltage VREF and bias voltage VBIAS are the same, and are provided by node VREF/VBIAS. These voltages are the same only for this specific example, and can be different in other implementations.

In the circuit of FIG. 3, the first stage amplifier A1 has two tail current paths. One is transistor 52 which is always on and provides a current of, for example, 2 uA. The other one is transistor 54 (PMOS switch) which provides a variable current up to, for example, 6 uA. Transistor 54 is controlled by node DRV through buffer BUF1 (transistors 48 and 50). The small buffer BUF1 is added to reduce the capacitive load on node DRV since transistor 54 can be a reasonably large switch. For this type of LDO, generally the pole on node DRV has to be pushed out for stability concern. When the LDO load current is small, the power PMOS PSW is turned on very weak, thus the transistor 54 is virtually off and amplifier A1 is only biased with a 2 uA tail current in this example. When the load current increases, node DRV moves lower and gradually turns on transistor 54. This provides extra bias current to amplifier A1. Consequently, the transconductance of amplifier A1 gradually increases, which increases the bandwidth of the LDO.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A low dropout voltage regulator circuit comprising:

a first amplifier having a reference voltage node coupled to a first input;

a second amplifier having an input coupled to an output of the first amplifier;

a variable bias current source coupled to the first amplifier and having a control node coupled to an output of the second amplifier;

a power switch having a control node coupled to the output of the second amplifier and having a first end coupled to a source voltage node; and a feedback circuit having an input coupled to a second end of the power switch and an output coupled to a second input of the first amplifier.

2. The circuit of claim 1 wherein a current in the variable bias current source increases when a current in the power switch increases, and decreases when the current in the power switch decreases.

3. The circuit of claim 1 further comprising a buffer coupled between the output of the second amplifier and the control node of the variable bias current source.

4. The circuit of claim 1 further comprising a buffer coupled between the output of the second amplifier and the control node of the power switch.

5. The circuit of claim 1 wherein the power switch is a transistor.

6. The circuit of claim 1 wherein the variable bias current source comprises a constant current source in parallel with an adjustable current source.

7. The circuit of claim 6 wherein the adjustable current source comprises a bias transistor having a control node coupled to the output of the second amplifier.

8. The circuit of claim 7 wherein the bias transistor is a MOS transistor.

9. The circuit of claim 7 further comprising a buffer coupled between the output of the second amplifier and the control node of the bias transistor.

10. The circuit of claim 9 wherein the buffer comprises:

a first buffer transistor having a control node coupled to the output of the second amplifier; and a second buffer transistor having a first end and a control node coupled to the control node of the bias transistor, and having a second end coupled to the first buffer transistor.

11. A circuit comprising:

a first amplifier;

a second amplifier having an input coupled to an output of the first amplifier;

a variable bias current source coupled to the first amplifier and having a control node coupled to an output of the second amplifier; and a power switch having a control node coupled to the output of the second amplifier.

12. The circuit of claim 11 wherein a current in the variable bias current source increases when a current in the power switch increases, and decreases when the current in the power switch decreases.

13. The circuit of claim 11 further comprising a feedback circuit having an input coupled to a second end of the power switch and an output coupled to an input of the first amplifier.

14. The circuit of claim 11 further comprising a buffer coupled between the output of the second amplifier and the control node of the variable bias current source.

15. The circuit of claim 11 further comprising a buffer coupled between the output of the second amplifier and the control node of the power switch.

16. The circuit of claim 11 wherein the power switch is a transistor.

17. The circuit of claim 11 wherein the variable bias current source comprises a constant current source in parallel with an adjustable current source.

18. The circuit of claim 17 wherein the adjustable current source comprises a bias transistor having a control node coupled to the output of the second amplifier.

19. The circuit of claim 18 further comprising a buffer coupled between the output of the second amplifier and the control node of the bias transistor.

20. The circuit of claim 19 wherein the buffer comprises:

a first buffer transistor having a control node coupled to the output of the second amplifier; and a second buffer transistor having a first end and a control node coupled to the control node of the bias transistor, and having a second end coupled to the first buffer transistor.

* * * * *